US010650744B2

(12) United States Patent
Jin et al.

(10) Patent No.: US 10,650,744 B2
(45) Date of Patent: May 12, 2020

(54) METHOD FOR COMPENSATING PIXEL DRIVING CIRCUIT OF OLED DISPLAY PANEL

(71) Applicant: Shenzhen China Star Optoelectronics Technology Co., Ltd., Shenzhen, Guangdong (CN)

(72) Inventors: Yufeng Jin, Guangdong (CN); Hongjun Xie, Guangdong (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 347 days.

(21) Appl. No.: 15/565,215

(22) PCT Filed: Aug. 25, 2017

(86) PCT No.: PCT/CN2017/098962
§ 371 (c)(1),
(2) Date: Oct. 9, 2017

(87) PCT Pub. No.: WO2019/000616
PCT Pub. Date: Jan. 3, 2019

(65) Prior Publication Data

US 2019/0385525 A1 Dec. 19, 2019

(30) Foreign Application Priority Data

Jun. 30, 2017 (CN) ..... 2017 1 0524907

(51) Int. Cl.
*G09G 3/3258* (2016.01)
*G09G 3/3208* (2016.01)
*G09G 3/3233* (2016.01)

(52) U.S. Cl.
CPC ..... *G09G 3/3258* (2013.01); *G09G 3/3208* (2013.01); *G09G 3/3233* (2013.01);
(Continued)

(58) Field of Classification Search
CPC ..... G09G 2320/043; G09G 3/3258; G09G 2320/0223; G09G 2320/045;
(Continued)

(56) References Cited

U.S. PATENT DOCUMENTS 8,378,938 B2 * 2/2013 Nathan ..... G09G 3/3233 345/78
9,830,854 B2 * 11/2017 Kim ..... G09G 3/3225
(Continued)

FOREIGN PATENT DOCUMENTS

CN 103093724 A * 5/2013
EP 2960894 B1 * 5/2019

OTHER PUBLICATIONS

PCT/CN2017/098962 WIPO International search report and written opinion, dated 2018.*
201710524907.1 Chinese office action, dated 2018.*

*Primary Examiner* — Julie Anne Watko

(57) ABSTRACT

Disclosed is a method for compensating a pixel driving circuit of an OLED display panel. In the compensation method, a driving transistor is enabled to operate stably in a saturation region for twice, and a threshold voltage of the driving transistor is calculated based on a collected charging voltage and charging time. A pixel driving circuit is compensated by establishing a threshold-voltage compensation table. The compensation method is easy to operate and can significantly improve a detecting speed of a threshold voltage. Moreover, an effect of a voltage-current conversion factor on detecting accuracy of a threshold voltage can be avoided.

17 Claims, 5 Drawing Sheets

(52) U.S. Cl.
CPC ..... *G09G 2320/0223* (2013.01); *G09G 2320/0233* (2013.01); *G09G 2320/0285* (2013.01); *G09G 2320/043* (2013.01); *G09G 2320/045* (2013.01)

(58) Field of Classification Search
CPC ..... G09G 2320/04; G09G 2320/0285; G09G 2320/0233; G09G 2320/02; G09G 2320/00; G09G 3/3208; G09G 3/3233
See application file for complete search history.

(56) References Cited

U.S. PATENT DOCUMENTS 10,032,838 B2 * 7/2018 Nie ..... G09G 3/3233
10,176,758 B2 * 1/2019 Nie ..... G09G 3/3225
10,475,385 B2 * 11/2019 Xu ..... G09G 3/3258
2006/0022305 A1 * 2/2006 Yamashita ..... G09G 3/2014 257/565
2010/0214273 A1 * 8/2010 Shirouzu ..... G09G 3/3233 345/205
2011/0254871 A1 * 10/2011 Yoo ..... G09G 3/3233 345/690
2011/0285691 A1 * 11/2011 Takasugi ..... G09G 3/3233 345/212
2013/0099692 A1 * 4/2013 Chaji ..... H05B 37/02 315/224
2013/0100173 A1 * 4/2013 Chaji ..... G09G 3/3275 345/690
2014/0225883 A1 * 8/2014 Chaji ..... G09G 3/3258 345/212
2014/0340432 A1 * 11/2014 Chaji ..... G09G 3/3233 345/690
2015/0084842 A1 * 3/2015 Kim ..... G09G 3/3233 345/76
2015/0130785 A1 * 5/2015 Shin ..... G09G 3/3233 345/213
2015/0187268 A1 * 7/2015 Tani ..... G09G 3/3233 345/77
2017/0004764 A1 * 1/2017 Kim ..... G09G 3/3225
2017/0337875 A1 * 11/2017 Jeon ..... G09G 3/3258
2019/0304370 A1 * 10/2019 Lu ..... G09G 3/3258

* cited by examiner

METHOD FOR COMPENSATING PIXEL DRIVING CIRCUIT OF OLED DISPLAY PANEL

CROSS-REFERENCE TO RELATED APPLICATIONS

This application claims the priority of Chinese patent application CN 201710524907.1, entitled "Method for compensating pixel driving circuit of OLED display panel" and filed on Jun. 30, 2017, the entirety of which is incorporated herein by reference.

FIELD OF THE INVENTION

The present disclosure relates to the technical field of display, and in particular, to a method for compensating a pixel driving circuit of an OLED display panel.

BACKGROUND OF THE INVENTION

OLED (Organic Light Emitting Diode) display devices have advantages of self-emission, low driving voltage, high luminous efficiency, short response time, high definition and contrast, large viewing angle, and flexible display, and are more and more widely used.

At present, main problems faced by OLED display devices in their application are short service life and severe parameter variations. Brightness of an OLED is determined by a current flowing through the OLED, but it is hard to realize control of a current. Therefore, accurate control of an OLED is always a core issue in the field. In the prior art, a compensation structure is usually provided to compensate a pixel driving circuit of an OLED display device.

SUMMARY OF THE INVENTION

One of the technical problems to be solved by the present disclosure is to provide a method for compensating a pixel driving circuit of an OLED display device. The method adopts a simple compensation structure and is easy to implement.

In order to solve the above problem, embodiments of the present application provide a method for compensating a pixel driving circuit of an OLED display device. The pixel driving circuit comprises a driving transistor and a storage capacitor. A first plate of the storage capacitor is connected to a gate of the driving transistor, and a second plate of the storage capacitor is connected to a source/drain of the driving to transistor and an anode of an OLED. The compensation method comprises following steps.

A detecting capacitor is provided for each pixel. A first plate of the detecting capacitor is connected to the anode of the OLED, and a second plate of the detecting capacitor is connected to ground.

The detecting capacitor is charged during a first detecting period, to a first charging voltage via the driving transistor, and a first charging time corresponding to the first charging voltage is recorded.

The detecting capacitor is charged during a second detecting period, to a second charging voltage via the driving transistor, and a second charging time corresponding to the second charging voltage is recorded.

A threshold voltage of the driving transistor is calculated based on the first charging voltage, the first charging time, the second charging voltage, and the second charging time.

A threshold-voltage compensation table is established based on the threshold voltage of the driving transistor, and the pixel driving circuit is compensated based on the threshold-voltage compensation table.

A value of a voltage between the two plates of the storage capacitor during the first detecting period is not equal to a value of a voltage between the two plates of the storage capacitor during the second detecting period.

Preferably, the step of charging the detecting capacitor during the first detecting period, to the first charging voltage via the driving transistor comprises following substeps.

A gate voltage of the driving transistor is reset, so that the driving transistor has a first gate voltage, and a source/drain voltage of the driving transistor is reset, so that the driving transistor has a first reference voltage.

A first driving voltage is applied to the drain/source of the driving transistor. The detecting capacitor is charged to the first charging voltage during the first charging time by the first driving voltage via the driving transistor.

Preferably, during the first charging time, a difference between the first gate voltage and the first reference voltage is kept unchanged and larger than the threshold voltage of the driving voltage. The driving transistor is in a saturation region during the first charging time.

Preferably, the step of charging the detecting capacitor during the second detecting period, to the second charging voltage via the driving transistor comprises following substeps.

The gate voltage of the driving transistor is reset, so that the driving transistor has a second gate voltage, and the source/drain voltage of the driving transistor is reset, so that the driving transistor has a second reference voltage.

A second driving voltage is applied to the drain/source of the driving transistor. The detecting capacitor is charged to the second charging voltage during the second charging time by the second driving voltage via the driving transistor.

Preferably, during the first charging time, a difference between the second gate voltage and the second reference voltage is kept unchanged and larger than the threshold voltage of the driving voltage. The driving transistor is in a saturation region during the second charging time.

Preferably, the step of resetting the source/drain voltage of the driving transistor comprises following substeps.

A voltage equal to the first reference voltage is continuously applied to the drain/source of the driving transistor during the first detecting period.

A voltage equal to the second reference voltage is continuously applied to the drain/source of the driving transistor during the second detecting period.

Preferably, the threshold voltage $V_{th}$ of the driving transistor is calculated based on a following formula:

$$V_{th} = \frac{\sqrt{(V_{t1} - V_{ref1}) * \frac{t_2}{t_1}} * V_{gs2} - \sqrt{(V_{t2} - V_{ref2})} * V_{gs1}}{\sqrt{(V_{t1} - V_{ref1}) * \frac{t_2}{t_1}} - \sqrt{(V_{t2} - V_{ref2})}}$$

where $V_{t1}$ represents the first charging voltage; $V_{t2}$ represents the second charging voltage; $V_{ref1}$ represents the first reference voltage; $V_{ref2}$ represents the second reference voltage; $t_1$ represents the first charging time; $t_2$ represents the second charging time; $V_{gs1}$ represents a voltage between the gate of the driving transistor and the source/drain of the driving transistor during the first detecting period; and $V_{gs2}$ represents a voltage between the gate of the driving transistor and the source/drain of the driving transistor during the second detecting period.

Preferably, the first gate voltage is not equal to the second gate voltage; the first reference voltage is equal to the second reference voltage; and the first driving voltage is equal to the second driving voltage.

Preferably, the step of providing the detecting capacitor for each pixel comprises following steps.

A thin film transistor is provided at the anode of the OLED. A source/drain of the thin film transistor is connected to the anode of the OLED. Drains/sources of thin film transistors of pixels in a same column are connected to one another by means of a wire, and the wire is connected to a designated pin of a designated chip. The detecting capacitor is formed by a parasitic capacitor located between the wire and ground.

Preferably, the step of compensating the pixel driving circuit based on the threshold-voltage compensation table comprises following substeps.

A digital signal corresponding to a grayscale data is received.

The digital signal is converted to a corresponding analog voltage.

A threshold-voltage compensation value corresponding to a pixel displaying the grayscale data is obtained according to the threshold-voltage compensation table, and an analog voltage after compensation is calculated according to the analog voltage and threshold-voltage compensation value.

The analog voltage after compensation is converted to a corresponding data signal, and the pixel driving circuit is compensated based on the corresponding data signal.

Compared with the prior art, one or more embodiments of the above technical solution have following advantages or beneficial effects.

A driving transistor is enabled to operate stably in a saturation region for twice, and a threshold voltage of the driving transistor is calculated based on a collected charging voltage and charging time. A pixel driving circuit is compensated by establishing a threshold-voltage compensation table. The method has advantages of simple structure and easy operation, and it can significantly improve detecting speed of a threshold voltage. Moreover, an effect of a voltage-current conversion factor on detecting accuracy of the threshold voltage can be avoided, and compensation costs can be lowered.

Other advantages, objectives, and features of the present disclosure will be further explained in the following description, and partially become self-evident therefrom, or be understood through the embodiments of the present disclosure. The objectives and advantages of the present disclosure will be achieved through the structure specifically pointed out in the description, claims, and the accompanying drawings.

BRIEF DESCRIPTION OF THE DRAWINGS

The accompanying drawings provide further understandings of the present disclosure or the prior art and constitute one part of the description. The drawings are used for interpreting the present disclosure together with the embodiments, not for limiting the present disclosure. In the drawings.

DETAILED DESCRIPTION OF THE EMBODIMENTS

The present disclosure will be explained in details with reference to the embodiments and the accompanying drawings, whereby it can be fully understood how to solve the technical problem by the technical means according to the present disclosure and achieve the technical effects thereof, and thus the technical solution according to the present disclosure can be implemented. It should be noted that, as long as there is no structural conflict, all the technical features mentioned in all the embodiments can be combined together in any manner, and the technical solutions obtained in this manner all fall within the scope of the present disclosure.

Figure 1:
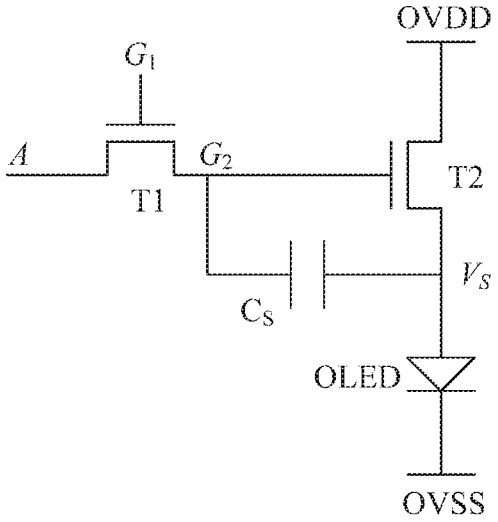
Fig. 1 (Prior Art)
FIG. 1 schematically shows a structure of a pixel driving circuit in the prior art.

FIG. 1 schematically shows a structure of a pixel driving circuit in the prior art. As shown in FIG. 1, the pixel driving circuit mainly comprises a first thin film transistor T1, a second thin film transistor T2, a storage capacitor Cs, and an OLED. T1 is a switching transistor, and T2 is a driving transistor. A signal $G_1$ is applied to a gate of T1 to open a charging path for a gate of T2. When $G_1$ is at a high level, the switching transistor T1 is turned on. A source/drain of T1 is configured to receive a data signal A from a data line, and the data signal A is transmitted to the gate of the driving transistor T2 via the source/drain of T1. Thus, the gate of T2 is charged to a predetermined voltage. The driving transistor T2 generates a driving current based on a gate voltage $G_2$ of the driving transistor T2 and a source/drain voltage $V_S$ thereof, such that the OLED is turned on and lighted, and further displays gray scale. The storage capacitor Cs is charged while the data signal A is charging the gate of T2. Besides, Cs can maintain a voltage applied between the gate and the source/drain of T2 after T1 is turned off, so that the OLED can be maintained in an On state. OVDD and OVSS in FIG. 1 are DC voltages applied to the driving transistor T2.

Embodiments provided in the present disclosure will be implemented based on the pixel driving circuit shown in FIG. 1, so as to detect a shift of a threshold voltage of the OLED. It should be noted that, the above pixel driving circuit is adopted merely to assist in explaining specific steps of the embodiments of the present disclosure, rather than limiting a compensation method described in the embodiments of the present disclosure. That is, in the embodiments of the present disclosure, as long as specified operation on two ends for control of turn-on and/or turn-off of the driving transistor T2 can be realized during a first detecting period and a second detecting period, the embodiments of the present disclosure can be substantially implemented regardless of a specific structure of the pixel driving circuit.

Figure 2:
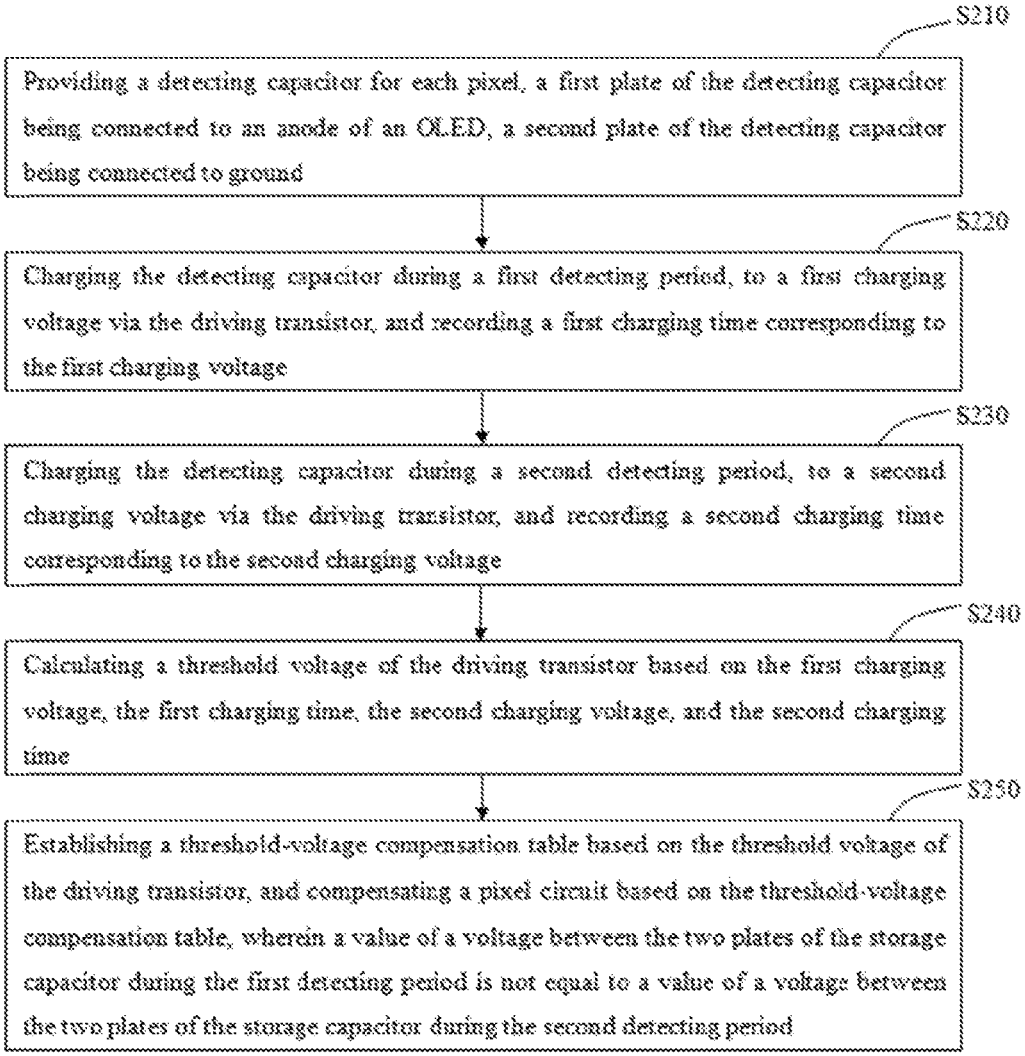
FIG. 2 is a flow chart showing a method for compensating a pixel driving circuit of an OLED according to embodiments of the present disclosure.

FIG. 2 is a flow chart showing a method for compensating a pixel driving circuit of an OLED according to the embodiments of the present disclosure. As shown in FIG. 2, the compensation method comprises following steps.

In step S210, a detecting capacitor is provided for each pixel. A first plate of the detecting capacitor is connected to an anode of the OLED, and a second plate thereof is connected to ground.

In step S220, the detecting capacitor is charged during a first detecting period, to a first charging voltage via a driving transistor, and a first charging time corresponding to the first charging voltage is recorded.

In step S230, the detecting capacitor is charged during a second detecting period, to a second charging voltage via the driving transistor, and a second charging time corresponding to the second charging voltage is recorded.

In step S240, a threshold voltage of the driving transistor is calculated based on the first charging voltage, the first charging time, the second charging voltage, and the second charging time.

In step S250, a threshold-voltage compensation table is established based on the threshold voltage of the driving transistor, and the pixel driving circuit is compensated based on the threshold-voltage compensation table.

During the above two charging processes, it is necessary to ensure that a value of a voltage between the two plates of the storage capacitor during the first detecting period is not equal to a value of a voltage between the two plates of the storage capacitor during the second detecting period.

Figure 3:
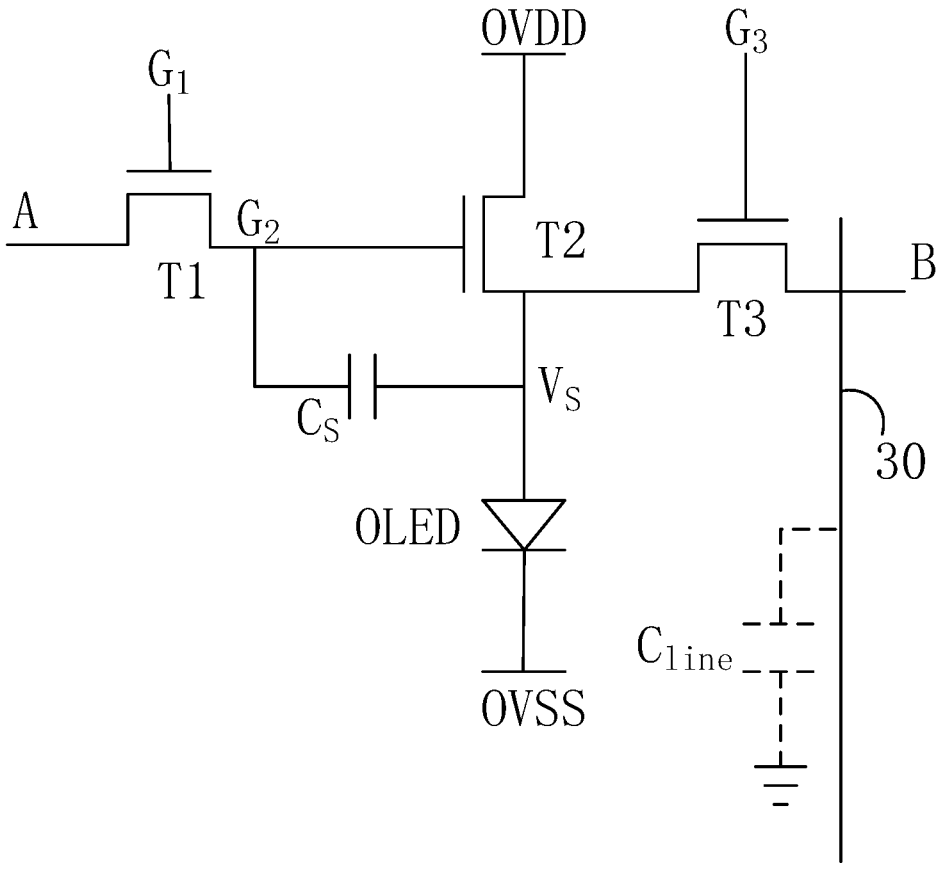
FIG. 3 is a schematic diagram showing detection of a threshold voltage in the pixel driving circuit by using the compensation method according to the embodiments of the present disclosure.

Specifically, in step S210, a structure for detecting a threshold voltage of the OLED is provided in each pixel driving circuit. As shown in FIG. 3, compared with the pixel driving circuit in FIG. 1, said pixel driving circuit further comprises a thin film transistor T3. A gate of T3 is connected with a signal $G_3$, a source/drain of T3 is connected to the source/drain of the driving transistor T2 and the anode of the OLED, and a drain/source of T3 is connected to a wire 30. As shown in FIG. 3, the pixel driving circuit is further provided with a wire 30. The wire 30 is used for connecting drains/sources of T3*s* of pixels located at a same column to one another. Furthermore, the wire 30 is connected to a designated pin of a designated chip for completing the detection (not shown in FIG. 3).

In general, a designated chip for completing the detection is provided on a COF flexible substrate and bonded at an edge of an array substrate using a TAB (Tape Automated Bonding) process. Therefore, the wire 30 and ground have a large parasitic capacitor therebetween, i.e. a capacitor Cline represented by the dotted line shown in FIG. 3. The parasitic capacitor Cline is configured to serve as a detecting capacitor. That is, a first plate of the detecting capacitor is connected to the anode of the OLED, and a second plate thereof is connected to ground.

When $G_3$ is at a high level, T3 is turned on, and the parasitic capacitor Cline is connected into the pixel driving circuit. The parasitic capacitor Cline is charged during the first detecting period and the second detecting period respectively, and corresponding data is recorded.

Figure 4:
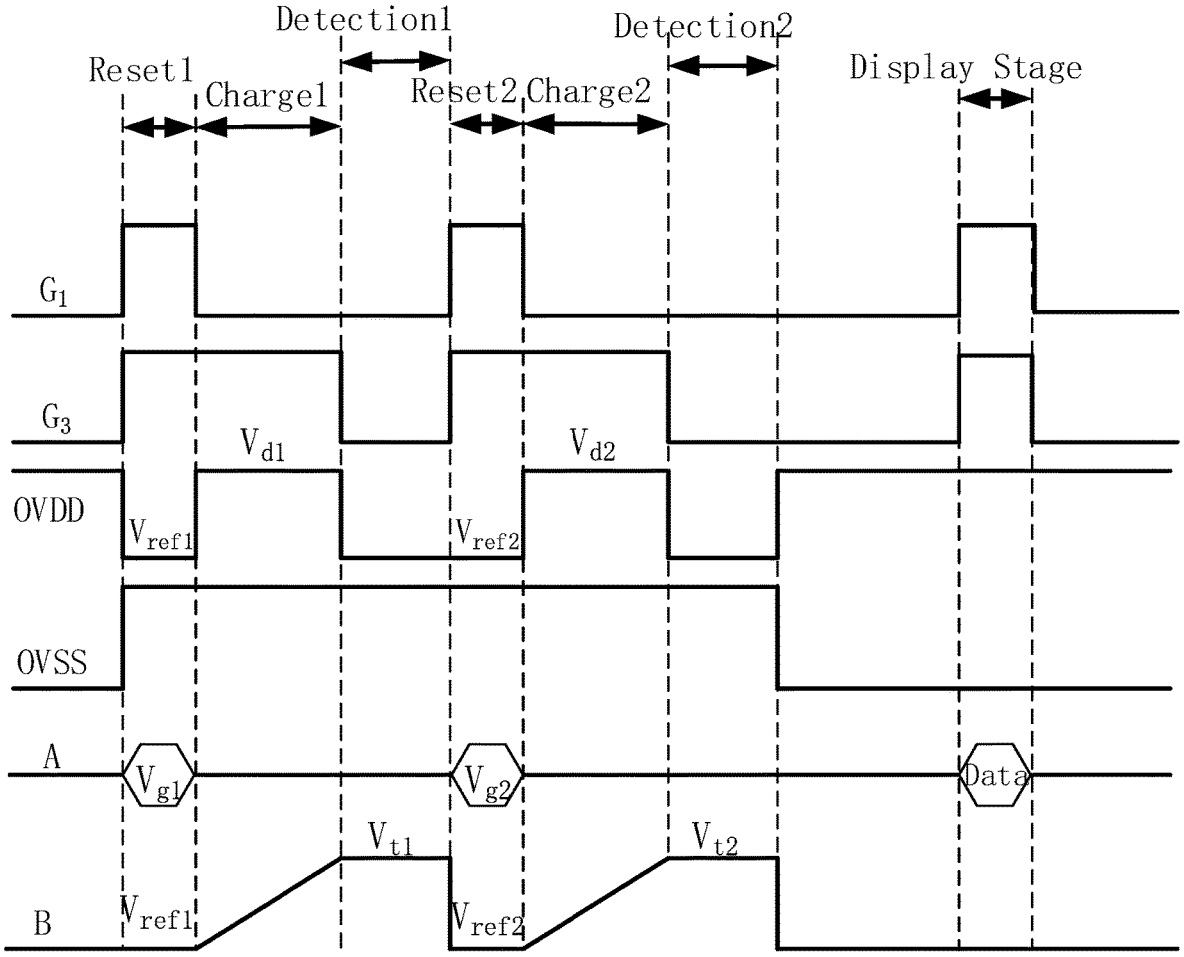
FIG. 4 is a timing diagram showing detection of the threshold voltage in the pixel driving circuit by using the compensation method according to the embodiments of the present disclosure.

In the embodiments of the present disclosure, the first detecting period and the second detecting period are each divided into three timing stages. As shown in FIG. 4, timing stages of the first detecting period are represented by Reset 1, Charge 1, and Detection 1, respectively; and timing stages of the second detection period are represented by Reset 2, Charge 2, and Detection 2, respectively.

In the timing stage Reset 1, the signal $G_1$ applied to the gate of T1 is made high, and the signal $G_3$ applied to a gate of T3 is made high. Because $G_1$ is at a high level, T1 is turned on. At the moment, the data signal transmitted in the data line has a first gate voltage $V_{g1}$, as shown in FIG. 4. The first gate voltage $V_{g1}$ is applied to the gate of the driving transistor T2 via T1, and thus the gate voltage $G_2$ of T2 is reset to $V_{g1}$. Because $G_3$ is at a high level, T3 is turned on. Meanwhile, a voltage signal is provided to the drain/source of T3, the voltage signal is enabled to have a first reference voltage $V_{ref1}$. As shown in FIG. 4, B represents a voltage at the drain/source of T3. The first reference voltage $V_{ref1}$ is applied to the source/drain of the driving transistor T2 via T3, and thus a voltage Vs at the source/drain of T2 is reset to $V_{ref1}$.

It should be noted that during a process of resetting the voltage at the gate of the driving transistor T2 and the voltage at the source/drain thereof, a constant high-level voltage is applied to a cathode of the OLED, as shown in FIG. 4, and thus the DC voltage OVSS can be kept high. When the OLED is not turned on normally, a leakage current would be produced in the OLED with an increase of a forward voltage difference between the anode and the cathode of the OLED. To avoid an effect of the leakage current on measuring results in following timing stages, the cathode of the OLED is continuously applied a high-level voltage in all the timing stages during the first detecting period and the second detecting period. In this manner, an increase of the forward voltage difference due to an increase of the voltage at the anode of the OLED can be avoided, and thus generation of a leakage current can further be avoided.

According to a preferred embodiment of the present disclosure, a reference voltage of an analog to digital converter for detection is connected to the cathode of the OLED.

In timing stage Charge 1. $G_1$ is made low, and $G_3$ is kept high. Because $G_1$ is at a low level, T1 is turned off. At the moment, the data signal A no longer has an effect on the gate of the driving transistor T2. Because $G_3$ is still at a high level, T3 maintains an On state. At this time, the voltage signal is no longer applied to the source/drain of T3, and a first driving voltage $V_{d1}$ is applied to the drain/source of the driving transistor T2 by means of the DC voltage OVDD, as shown in FIG. 4.

Due to an effect of the storage capacitor Cs, a voltage difference between the gate of T2 and the source/drain thereof is maintained, i.e., $V_{g1}-V_{ref1}$ (namely $V_{gs1}$) remains unchanged. A difference between $V_{g1}$ and $V_{ref1}$ is preset to be larger than a threshold voltage of the driving transistor T2, i.e., T2 would be turned on under an action of $V_{gs1}$.

Further, the first gate voltage $V_{g1}$, the first reference voltage $V_{ref1}$, and first driving voltage $V_{d1}$ are preset as such that the driving transistor T2 can operate in a saturation region at the above voltages. Therefore, after the first driving voltage $V_{d1}$ is applied to the drain/source of T2, a constant current $I_1$ is generated in an output branch of T2.

Because the cathode of the OLED is connected to the high-level DC voltage OVSS, the OLED is not turned on. Moreover, in presetting a specific value of the high-level DC voltage OVSS, it is ensured that the OLED is still in an Off state when the voltage Vs at the source/drain of T2 is charged to a high voltage.

When the above-described conditions are satisfied, the current $I_1$ is maintained constant and continues to charge the detecting capacitor Cline. Thus, the voltage Vs at the source/drain of T2 is increased. Since a voltage difference between the two plates of the storage capacitor Cs is maintained, the voltage Vs is increased linearly, as shown by B in FIG. 4. With the increase of Vs, the voltage $G_2$ at the gate of T2 is increased accordingly.

It should be noted that, when T3 is turned on, the voltage Vs at the source/drain of T2, i.e., a voltage at the anode of the OLED can be considered equal to the voltage at the drain/source of T3, i.e., a voltage at the first plate of the detecting capacitor Cline.

When a value of Vs reaches a first charging voltage $V_{t1}$, it proceeds to the timing stage Detection 1. In the timing stage Detection 1. $G_1$ is maintained low, and $G_3$ is low. Thus, T3 is turned off. On this occasion, the first charging voltage $V_{t1}$ is maintained at the drain/source of T3, i.e., at the first plate of the detecting capacitor Cline. The first charging voltage $V_{t1}$ is read at the first plate of the detecting capacitor Cline by using an analog to digital converter. Meanwhile, the first charging time $t_1$ during which the first charging voltage $V_{t1}$ is obtained is recorded. At this point, the first detecting period is over, and detection data $V_{t1}$ and $t_1$ is obtained.

During the subsequent second detecting period, same operation as in the first detecting period is repeated. Specific timing stages are shown in FIG. 4 and will not be repeated herein. After the second detecting period is finished, detection data $V_{t2}$ and $t_2$ can be obtained. $V_{t2}$ is a second charging voltage, and $t_2$ is a second charging time corresponding to the second charging voltage.

It should be noted that, in two charging processes, it is necessary to ensure that a value of a voltage between the two plates of the storage capacitor during the first detecting period is not equal to a value of a voltage between the two plates of the storage capacitor during the second detecting period.

In addition, in a specific embodiment of the present disclosure, in the timing stages of Preset of the above-described two detecting periods, during the process of applying a reference voltage (first reference voltage or second reference voltage) to the source/drain of the driving transistor T2 so as to reset the source/drain voltage Vs of T2, a voltage equal to the first reference voltage $V_{ref1}$ (in the first detecting period) or the second reference voltage $V_{ref2}$ (in the second detecting period) is continuously applied to the drain/source of T2, as OVDD shown in FIG. 4. In this manner, voltage division due to resistance on output paths of T2 and T3 can be prevented during charging of the source/drain of T2. Such voltage division can lead to failure to charge Vs to a voltage of a value equal to $V_{ref1}$ or $V_{ref2}$, thereby affecting detection accuracy.

Next, in step S240, a first relational expression is established based on the detected first charging voltage $V_{t1}$ and the first charging time $t_1$, as shown in Expression (1). A second relational expression is established based on the detected second charging voltage $V_{t2}$ and the second charging time $t_2$, as shown in Expression (2).

$$\frac{C_{line} * (V_{t1} - V_{ref1})}{t1} = I_1 = k(V_{gs1} - V_{th})^2 \quad (1)$$

$$\frac{C_{line} * (V_{t2} - V_{ref2})}{t2} = I_2 = k(V_{gs2} - V_{th})^2 \quad (2)$$

In Expressions (1) and (2), $V_{th}$ represents the threshold voltage of the driving transistor T2; $Vt_1$ represents the first charging voltage; $Vt_2$ represents the second charging voltage; $V_{ref1}$ represents the first reference voltage; $V_{ref2}$ represents the second reference voltage; $t_1$ represents the first charging time; and $t_2$ represents the second charging time. $V_{gs1}$ represents a voltage applied between the gate of the driving transistor T2 and the source/drain thereof during the first detecting period; and $V_{gs2}$ represents a voltage applied between the gate of the driving transistor T2 and the source/drain thereof during the second detecting period. $I_1$ represents the charging current in the timing stage Charge 1, and $I_2$ represents the charging current in the timing stage Charge 2. $C_{line}$ represents capacitance of the detecting capacitor, and k represents the voltage-current conversion factor of the driving transistor T2.

An expression for calculating the threshold voltage $V_{th}$ is obtained based on Expressions (1) and (2), as shown in Expression (3):

$$V_{th} = \frac{\sqrt{(V_{t1} - V_{ref1}) * \frac{t_2}{t_1}} * V_{gs2} - \sqrt{(V_{t2} - V_{ref2})} * V_{gs1}}{\sqrt{(V_{t1} - V_{ref1}) * \frac{t_2}{t_1}} - \sqrt{(V_{t2} - V_{ref2})}} \quad (3)$$

The above detecting method is applied to each pixel in an active area of an OLED display panel, and thus a threshold voltage corresponding to each of pixels can be obtained.

In order to further simplify the operation, in a preferred embodiment of the present disclosure, the first gate voltage $V_{g1}$ is not equal to the second gate voltage $V_{g2}$, and the first reference voltage $V_{ref1}$ is equal to the second reference voltage $V_{ref2}$, so as to meet a requirement that $V_{gs1}$ be not equal to $V_{gs2}$. Further, the first driving voltage $V_{d1}$ and the second driving voltage $V_{d2}$ can be made equal. It is only necessary to ensure that, a value of a voltage between the two plates of the storage capacitor Cs during the first detecting period is not equal to a value of a voltage between the two plates of the storage capacitor Cs during the second detecting period. Those skilled in the art can reasonably set values of the voltages according to actual operation, and can adjust the charging time of the detecting capacitor Cline. The present disclosure is not limited to any of the above descriptions. For example, when a voltage applied between the gate of the driving transistor T2 and the source/drain thereof is relatively small, rising of Vs would be relatively slow. In order to read the charging voltage in a preferable range of linearity of the analog to digital converter, it is necessary to extend the charging time appropriately.

Subsequently, in step S250, a threshold-voltage compensation table is established based on the threshold voltage; and the pixel driving circuit is compensated based on the threshold-voltage compensation table.

Figure 5:
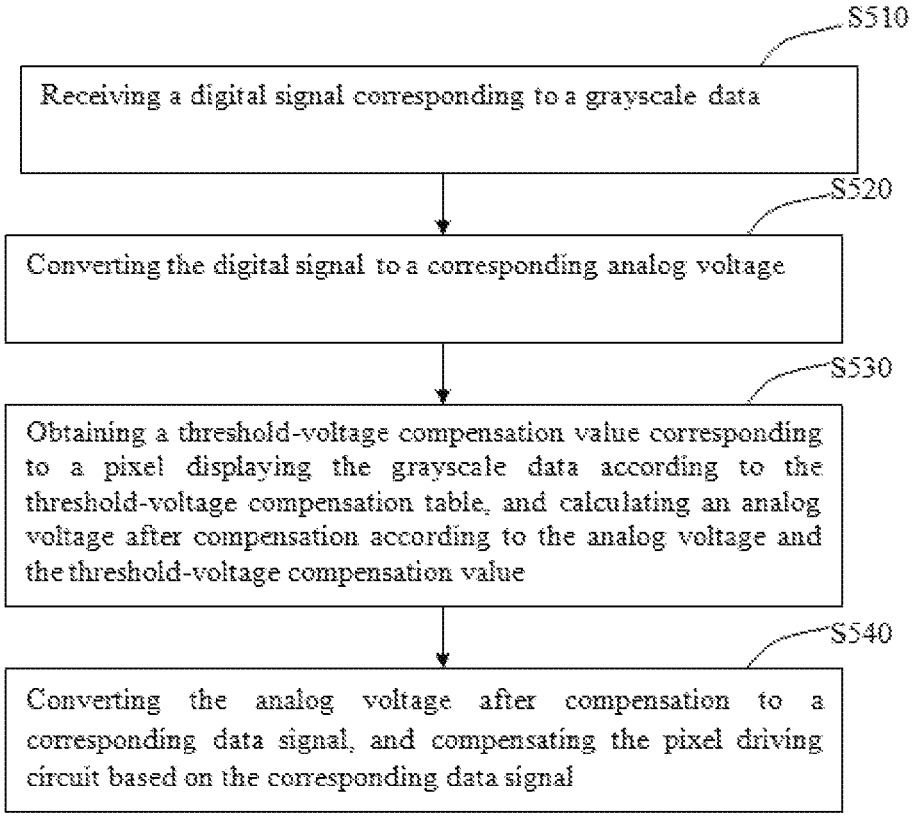
FIG. 5 is a flow chart showing compensation of the pixel driving circuit based on a threshold-voltage compensation table obtained by using the compensation method according to the embodiments of the present disclosure.

The step of compensating the pixel driving circuit based on the threshold-voltage compensation table specifically comprises following steps, as shown in FIG. 5.

In step S510, a digital signal corresponding to a grayscale data is received.

In step S520, the digital signal is converted to a corresponding analog voltage.

In step S530, a threshold-voltage compensation value corresponding to a pixel displaying the grayscale data is obtained based on the threshold-voltage compensation table; and an analog voltage after compensation is calculated based on the analog voltage and the threshold-voltage compensation value.

In step S540, the analog voltage after compensation is converted to a corresponding data signal; and the pixel driving circuit is compensated based on the corresponding data signal.

Specifically, in step S510, the received digital signal is a digital code of a theoretical driving voltage determined according to a display request of an image. In step S520, the digital signal is processed with a Gamma IC and converted into a driving voltage when a threshold voltage drift is not taken into account. In step 530, the threshold-voltage compensation table is searched, and a driving voltage is calculated when the threshold voltage drift is taken into account. In step 540, a conversion inverse to the conversion in step S520 is made. The recalculated driving voltage is converted to a corresponding digital signal by using the Gamma IC. The digital signal can be used as an input signal for a data driving circuit to drive an OLED display surface.

The method for compensating a pixel driving circuit provided by the embodiment of the present disclosure is implemented by simply adding a simple structure to a conventional pixel driving circuit and can detect a threshold voltage of a driving transistor.

In the embodiments of the present disclosure, a driving transistor is enabled to operate stably in a saturation region for twice, and a threshold voltage of the driving transistor can be calculated. The method is easy to operate and can significantly improve a detecting speed of a threshold voltage. Furthermore, an effect of a voltage-current conversion factor on detecting accuracy of the threshold voltage can be avoided, and compensation costs can be lowered.

The above embodiments are described only for better understanding, rather than restricting, the present disclosure. Any person skilled in the art can make amendments to the implementing forms or details without departing from the spirit and scope of the present disclosure. The protection scope of the present disclosure shall be determined by the scope as defined in the claims.

The invention claimed is:

1. A method for compensating a pixel driving circuit of an OLED display panel, wherein the pixel driving circuit comprises a driving transistor and a storage capacitor, wherein a first plate of the storage capacitor is connected to a gate of the driving transistor, and a second plate of the storage capacitor is connected to a source/drain of the driving transistor and an anode of an OLED; and wherein the method comprises steps of:

providing a detecting capacitor for each pixel, a first plate of the detecting to capacitor being connected to the anode of the OLED, and a second plate of the detecting capacitor being connected to ground;

charging the detecting capacitor during a first detecting period, to a first charging voltage via the driving transistor, and recording a first charging time corresponding to the first charging voltage;

charging the detecting capacitor during a second detecting period, to a second charging voltage via the driving transistor, and recording a second charging time corresponding to the second charging voltage;

calculating a threshold voltage of the driving transistor based on the first charging voltage, the first charging time, the second charging voltage, and the second charging time; and establishing a threshold-voltage compensation table based on the threshold voltage of the driving transistor, and compensating the pixel driving circuit based on the threshold-voltage compensation table, wherein a value of a voltage between the two plates of the storage capacitor during the first detecting period is not equal to a value of a voltage between the two plates of the storage capacitor during the second detecting period.

2. The compensation method according to claim 1, wherein the step of charging the detecting capacitor in the first detecting period, to the first charging voltage via the driving transistor comprises substeps of:

resetting a gate voltage of the driving transistor, so that the driving transistor has a first gate voltage, and resetting a source/drain voltage of the driving transistor, so that the driving transistor has a first reference voltage; and applying a first driving voltage to the drain/source of the driving transistor, wherein the detecting capacitor is charged to the first charging voltage during the first charging time by the first driving voltage via the driving transistor.

3. The compensation method according to claim 2, wherein a difference between the first gate voltage and the first reference voltage is kept unchanged during the first charging time and larger than the threshold voltage of the driving voltage, and the driving transistor is in a saturation region during the first charging time.

4. The compensation method according to claim 3, wherein the step of charging to the detecting capacitor during the second detecting period, to the second charging voltage via the driving transistor comprises substeps of:

resetting the gate voltage of the driving transistor, so that the driving transistor has a second gate voltage, and resetting the source drain voltage of the driving transistor, so that the driving transistor has a second reference voltage; and applying a second driving voltage to the drain/source of the driving transistor, wherein the detecting capacitor is charged to the second charging voltage during the second charging time by the second driving voltage via the driving transistor.

5. The compensation method according to claim 4, wherein a difference between the second gate voltage and the second reference voltage is kept unchanged during the second charging time and larger than the threshold voltage of the driving voltage, and the driving transistor is in a saturation region during the second charging time.

6. The compensation method according to claim 5, wherein the step of resetting the source/drain voltage of the driving transistor comprises substeps of:

applying a voltage equal to the first reference voltage to the drain/source of the driving transistor continuously during the first detecting period; and applying a voltage equal to the second reference voltage to the drain/source of the driving transistor continuously during the second detecting period.

7. The compensation method according to claim 6, wherein the threshold voltage $V_{th}$ of the driving transistor is calculated based on a following formula:

$$V_{th} = \frac{\sqrt{(V_{t1} - V_{ref1}) * \frac{t_2}{t_1}} * V_{gs2} - \sqrt{(V_{t2} - V_{ref2})} * V_{gs1}}{\sqrt{(V_{t1} - V_{ref1}) * \frac{t_2}{t_1}} - \sqrt{(V_{t2} - V_{ref2})}}$$

where $V_{t1}$ represents the first charging voltage; $V_{t2}$ represents the second charging voltage; $V_{ref1}$ represents the first reference voltage; $V_{ref2}$ represents the second reference voltage; $t_1$ represents the first charging time; $t_2$ represents the second charging time; $V_{gs1}$ represents a voltage between the gate of the driving transistor and the source/drain of the driving transistor during the first detecting period; and $V_{gs2}$ represents a voltage between the gate of the driving transistor and the source/drain of the driving transistor during the second detecting period.

8. The compensation method according to claim 7, wherein the step of providing a detecting capacitor for each pixel comprises:

providing a thin film transistor at the anode of the OLED, wherein a source/drain of the thin film transistor is connected to the anode of the OLED, and drains/sources of thin film transistors of pixels located at a same column are connected to one another by means of a wire, the wire being connected to a designated pin of a designated chip, wherein a parasitic capacitor located between the wire and ground forms the detecting capacitor.

9. The compensation method according to claim 6, wherein the step of providing a detecting capacitor for each pixel comprises:

providing a thin film transistor at the anode of the OLED, wherein a source/drain of the thin film transistor is connected to the anode of the OLED, and drains/sources of thin film transistors of pixels located at a same column are connected to one another by means of a wire, the wire being connected to a designated pin of a designated chip, wherein a parasitic capacitor located between the wire and ground forms the detecting capacitor.

10. The compensation method according to claim 5, wherein the first gate voltage is not equal to the second gate voltage, the first reference voltage is equal to the second reference voltage, and the first driving voltage is equal to the second driving voltage.

11. The compensation method according to claim 10, wherein the step of providing a detecting capacitor for each pixel comprises:

providing a thin film transistor at the anode of the OLED, wherein a source/drain of the thin film transistor is connected to the anode of the OLED, and drains/sources of thin film transistors of pixels located at a same column are connected to one another by means of a wire, the wire being connected to a designated pin of a designated chip, wherein a parasitic capacitor located between the wire and ground forms the detecting capacitor.

12. The compensation method according to claim 5, wherein the step of providing a detecting capacitor for each pixel comprises:

providing a thin film transistor at the anode of the OLED, wherein a source/drain of the thin film transistor is connected to the anode of the OLED, and drains/sources of thin film transistors of pixels located at a same column are connected to one another by means of a wire, the wire being connected to a designated pin of a designated chip, wherein a parasitic capacitor located between the wire and ground forms the detecting capacitor.

13. The compensation method according to claim 4, wherein the step of providing a detecting capacitor for each pixel comprises:

providing a thin film transistor at the anode of the OLED, wherein a source/drain of the thin film transistor is connected to the anode of the OLED, and drains/sources of thin film transistors of pixels located at a same column are connected to one another by means of a wire, the wire being connected to a designated pin of a designated chip, wherein a parasitic capacitor located between the wire and ground forms the detecting capacitor.

14. The compensation method according to claim 3, wherein the step of providing a detecting capacitor for each pixel comprises:

providing a thin film transistor at the anode of the OLED, wherein a source/drain of the thin film transistor is connected to the anode of the OLED, and drains/sources of thin film transistors of pixels located at a same column are connected to one another by means of a wire, the wire being connected to a designated pin of a designated chip, wherein a parasitic capacitor located between the wire and ground forms the detecting capacitor.

15. The compensation method according to claim 2, wherein the step of providing a detecting capacitor for each pixel comprises:

providing a thin film transistor at the anode of the OLED, wherein a source/drain of the thin film transistor is connected to the anode of the OLED, and drains/sources of thin film transistors of pixels located at a same column are connected to one another by means of a wire, the wire being connected to a designated pin of a designated chip, wherein a parasitic capacitor located between the wire and ground forms the detecting capacitor.

16. The compensation method according to claim 1, wherein the step of providing a detecting capacitor for each pixel comprises:

providing a thin film transistor at the anode of the OLED, wherein a source/drain of the thin film transistor is connected to the anode of the OLED, and drains/sources of thin film transistors of pixels located at a same column are connected to one another by means of a wire, the wire being connected to a designated pin of a designated chip, wherein a parasitic capacitor located between the wire and ground forms the detecting capacitor.

17. The compensation method according to claim 1, wherein the step of compensating the pixel driving circuit based on the threshold-voltage compensation table comprises substeps of:

receiving a digital signal corresponding to a grayscale data;

converting the digital signal to a corresponding analog voltage;

obtaining a threshold-voltage compensation value corresponding to a pixel displaying the grayscale data according to the threshold-voltage compensation table, and calculating an analog voltage after compensation according to the analog voltage and the threshold-voltage compensation value; and converting the analog voltage after compensation to a corresponding data signal, and compensating the pixel driving circuit based on the corresponding data signal.

* * * * *